United States Patent [19]

Lin

[11] Patent Number: 4,761,096

[45] Date of Patent: Aug. 2, 1988

[54] UNIVERSAL FOOTING WITH JETTING SYSTEM

[76] Inventor: Sheng S. Lin, 2859 Corte Caballos, Camarillo, Calif. 93010

[21] Appl. No.: 17,967

[22] Filed: Feb. 24, 1987

[51] Int. Cl.[4] ..... E02B 17/00

[52] U.S. Cl. ..... 405/195; 405/226; 405/248

[58] Field of Search ..... 405/226, 203, 240, 241, 405/242, 243, 248, 195

[56] References Cited

U.S. PATENT DOCUMENTS

| | | | |
|---|---|---|---|
| 225,061 | 3/1880 | Johnson | 405/248 |
| 1,686,738 | 10/1928 | Ellis | 405/248 |
| 2,146,645 | 2/1939 | Newman | 405/248 X |
| 2,897,654 | 8/1959 | Harris | 405/226 X |
| 3,808,823 | 5/1974 | Chelminski | 405/240 X |
| 4,109,477 | 8/1978 | Vogel | 405/226 X |
| 4,269,542 | 5/1981 | Mueller | 405/203 X |
| 4,433,943 | 2/1984 | Pao Chen | 405/241 |
| 4,505,615 | 3/1985 | Evans | 405/203 X |

FOREIGN PATENT DOCUMENTS

| | | | |
|---|---|---|---|
| 1550641 | 8/1979 | United Kingdom | 405/203 |

*Primary Examiner*—Dennis L. Taylor
*Attorney, Agent, or Firm*—J. M. St. Amand

[57] ABSTRACT

A universal footing and jetting system for marine platforms and structures comprises a spud-can forming an enlarged footing base to distribute loadings over a large soil area and thus increase bearing load capacity while reducing required pile penetration depth, a conical spike means for supporting the structural weight on and indenting into coral or rock type seafloors, and an internal jetting system to fluidize the soil around the footing for ease in penetration of the footing into the seafloor and the removal of the footing therefrom.

21 Claims, 3 Drawing Sheets

UNIVERSAL FOOTING WITH JETTING SYSTEM

BACKGROUND OF THE INVENTION

The present invention pertains to jack-up type marine platform structures, and more particularly to a universal footing for supporting the legs of such structures.

Marine jack-up platforms are used to form piers, causeways, and to support spanning structures which bridge between platforms. The platforms can be self-elevated to a specific height above the water surface using a jacking mechanism. In order to accommodate a wide range of seafloor types, the platforms need to be supported by footings in various seafloor soils, such as sand, silt, mud and rock.

Existing foundation systems usually rely on driven-pile foundations. In soft sediments, the total pile penetration depth can exceed 200 feet per leg. Such long pile driving and splicing operations are both time-consuming and labor-intensive. In addition, excessive shipping space is required to carry the extra piles, and shipping space is usually at a premium. In the areas of offshore drilling, exploration and production for the oil and gas industry, foundation footing types are usually pre-determined based upon site specific geotechnical data. In general, a sharp-pointed spike is used for foundations on rock or coral, while an enlarged base plate is usually selected for foundations on soft sediments.

One footing system that has been developed uses a jet eductor which generates suction-type flow for removing soil from underneath the footing through a metal strainer, so as to allow the footing to move down into the sediments. The eductor system, however, can easily be plugged up by seaweed, debris and soil containing large rocks, thereby becoming inoperative.

The instant invention, by using internal jetting to shoot water out of nozzles, avoids plugging problems, and works for clay, silt, sand, gravel, coral or rock seafloors. The jetting system of the present invention also assists in burying the footing into the seafloor, thus enhancing the overall system stability, and, in addition reduces the pullout resistance of the leg/footing upon retrieval. This invention is usefull for jetting-in various types of pilings and can be used for a variety of other marine construction.

SUMMARY OF THE PRESENT INVENTION

The universal footing of the present invention basically consists of three parts: a cone shaped spike to support the structural weight on rock or coral type seafloors, an enlarged footing base spud-can to reduce required pile length for foundations on soft sediments, and an internal jetting system to fluidize the soil around the footing for ease in penetration and removal.

The spike is a cone structure designed to indent into coral or soft rock. The spud-can is an enlarged hollow can which distributes loadings over a large soil area thus increasing bearing load capacity of the platform legs and reducing the required penetration depth. The jetting system assists in burying the footing into sandy, gravel and silt types of seafloor, for enhancing the overall system stability. In addition, jetting reduces the pullout resistance of the leg/footing system upon retrieval.

High-pressure jetting has been used for a variety of applications including sediment removal and rock cutting. Thes applications utilize a pressurized fluid released from nozzles which are not in direct contact with the target materials. In the case of the universal footing, the nozzles are fully embedded in the soil and the soil's engineering properties have a great influence on the jetting performance.

The engineering soil properties pertinent to jetting are: soil strength (cohesion, angle of internal friction), unit weight, permeability, gradation and compaction. These parameters govern soil shear strength, which could be the most important soil property affecting jetting performance. Jetting can temporarily reduce the soil shear strength thus facilitating footing penetration and pullout. On sandy type seafloors, without jetting a footing penetration depth will be very small. Jetting enables a footing of this invention to penetrate sufficiently into seafloor soils, like sand, to enhance stability of a marine structure or jack-up platform against sliding or overturning, and reduces scour potential.

When a jackup footing is deployed into a seafloor, the increase in pullout resistance can increase the overall stability of the jack-up platform against overturning. Unfortunately, increasing the pullout resistance makes retrieval of a jack-up footing more difficult. Jetting, as used in the present invention, however, can reduce the pullout resistance making footing retrieval and platform or causeway redeployment or realignment much easier.

The pullout resistance of a footing comprises a combination of soil resistance and footing structure weight. An embedded universal footing develops soil pullout resistance similar to a plate anchor. Jetting, however, eliminates the suction developed below the universal footing through reducing the soil strength by softening the soil around the footing. Jetting operates to loosen and fluidize seafloor soil, and thereby decrease the effective friction angle in the soil mass.

Jetting-in of the universal footing fluidizes non-cohesive soils and buries the footing by its own weight. Penetration rate depends upon the pressure and the flow rate of liquid through the jet nozzles. Once the universal footing is embedded in sandy seafloor soil, for example, upward or downward air jetting tends to compact the soils around the footing and "lock" the footing in place.

Jetting makes footing retrieval easier by: decreasing the suction developed below the footing, and by reducing the soil resistance. Pullout can be reduced as much as 80 percent in non-cohesive seafloor soils such as silt, sand and gravel, and by 40 percent in cohesive seafloor materials such as clay. Tests have shown that downward water jetting reduces pullout resistance more effectively than upward water jetting.

Further objects and advantages of the invention will become apparent from the description which follows in conjunction with the accompanying drawings.

DESCRIPTION OF THE PREFERRED EMBODIMENTS

Figure 1:
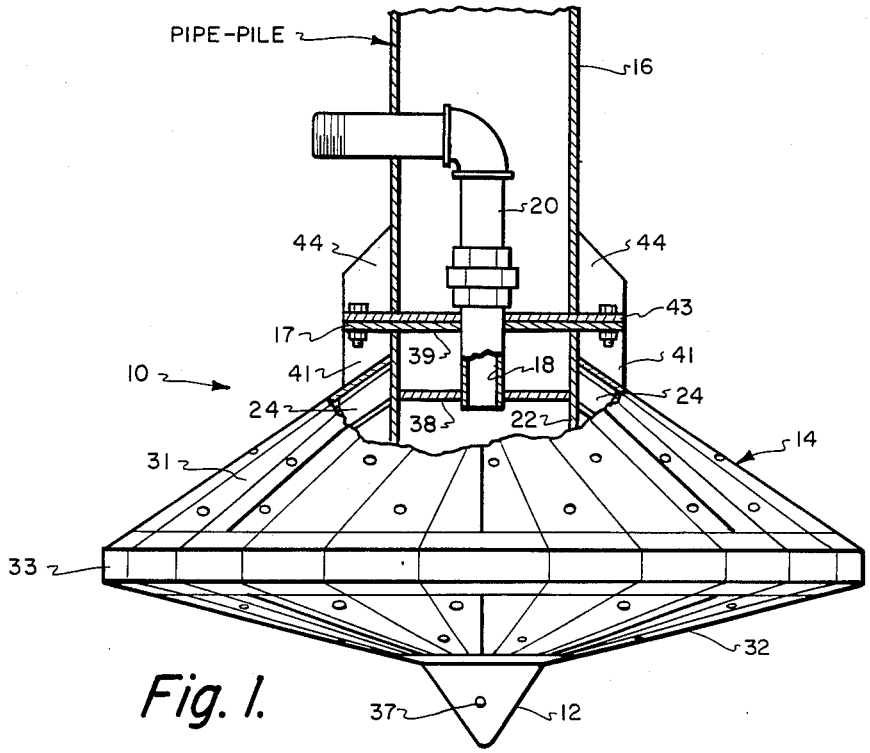
FIG. 1 is a partially cutaway elevational view of a preferred embodiment of the universal footing of the present invention, shown attached to the bottom of a pipe pile.
Figure 2:
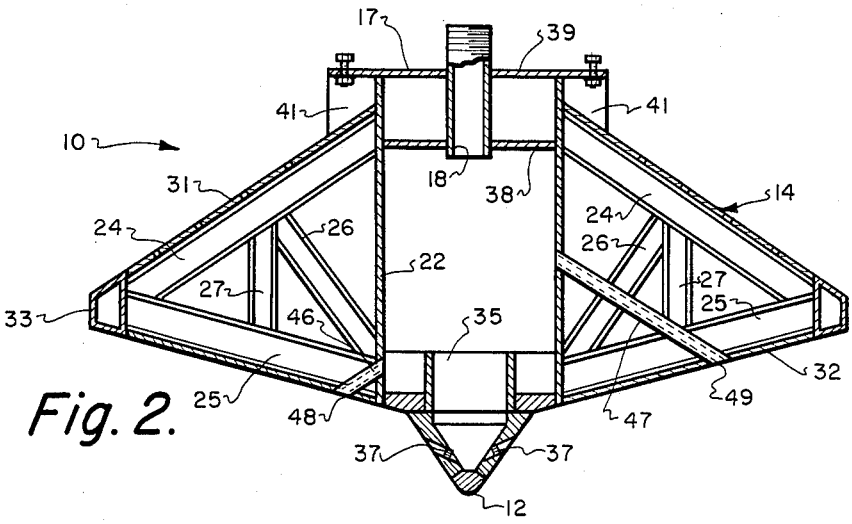
FIG. 2 is a cross-sectional view of the universal footing shown in FIG. 1.
Figure 4A:
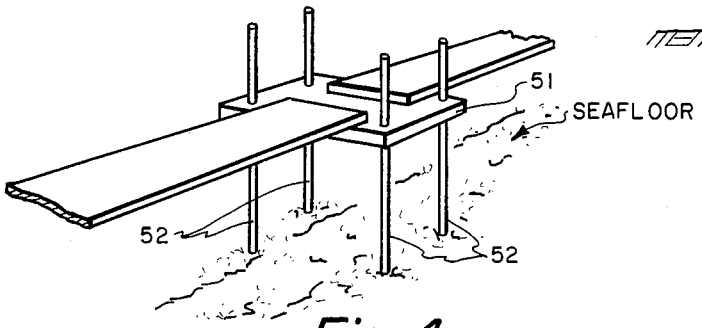
FIG. 4*a* is a perspective view of a typical jack-up marine platform supported on pilings.
Figure 4B:
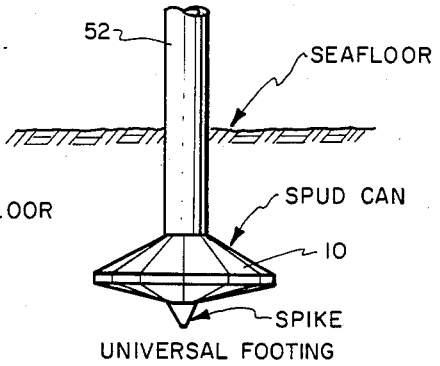
FIG. 4*b* shows a typical pile leg having a universal footing which is embedded in a seafloor.
Figure 4C:
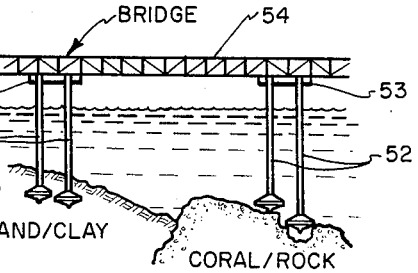
FIG. 4c is an elevational view showing a bridge structure supported on legs having universal footings resting in various seafloor materials.

Referring to FIGS. 1 and 2 of the drawings, the universal footing 10 of the present invention consists essentially of three basic parts: a spike 12, a spud-can 14, and a jetting system which will be hereinafter described below in relation to FIGS. 5 through 8. The spud-can 14 is an enlarged hollow can which distributes loadings over a large soil area thus increasing the bearing load capacity of the legs and reducing the penetration depth required.

The universal footing 10 is constructed to be attached to the leg of a marine platform, pier or other structure, such as pipe pile 16, by bolting to a flange 17 at the top of the footing, for example, or with other suitable connection means. A water (or other fluid) inlet 18 is provided at the top of the footing to operate the jetting system. High pressure water, etc., is provided to inlet 18 via a connection to a pipe line 20 at the bottom of pile leg 16. A high pressure flexible line can also be used in place of or in conjunction with pipe line 20, and can pass through the end of the pile 16, as shown, or be connected to an inlet or inlets, such as inlet 18, positioned elsewhere at the top of spud-can 14.

Spud-can 14 provides an enlarged footing base which operates to reduce the normally required pile length for foundations on soft sediments. Once the spud-can is embedded, it provides the major portions of: capacity against bearing failure; lateral resistance against sliding; and, resistance against pullout. The spud-can 14 is preferably constructed from structural steel in a generally conical shape, as shown, with a cylindrical chamber 22 at the center or hub into which pressurized water is fed for distribution to the jetting networks described below. Chamber 22 is preferrably constructed from structural steel similar to pipe pile 16 to provide good bearing support for the marine structure. A framework of structural steel beams 24, 25, 26 and 27, for example, are attached to cylindrical chamber 22 to form a wheel shaped structure with conical sides, such as shown. The framework is enclosed with plate steel 31, 32 and 33, for example, at the top, at the bottom and about the periphery, respectively.

Figure 3:
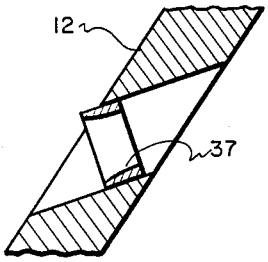
FIG. 3 is an enlarged detailed cross-sectional view of a typical jet nozzle used on the universal footing shown in FIG. 2.
Figure 5:
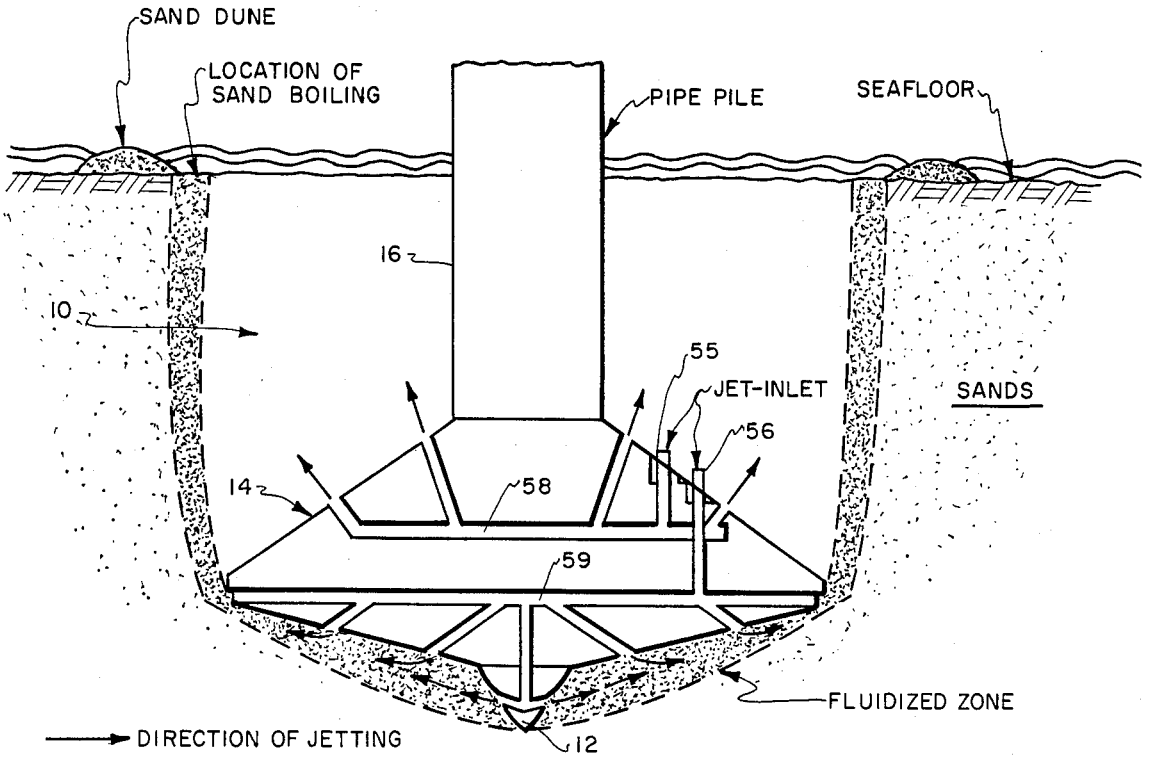
FIG. 5 is a schematic illustration of the universal footing in operation and embedded, in a seafloor showing jetting directions and the seafloor soil fluidized zone.
Figure 8:
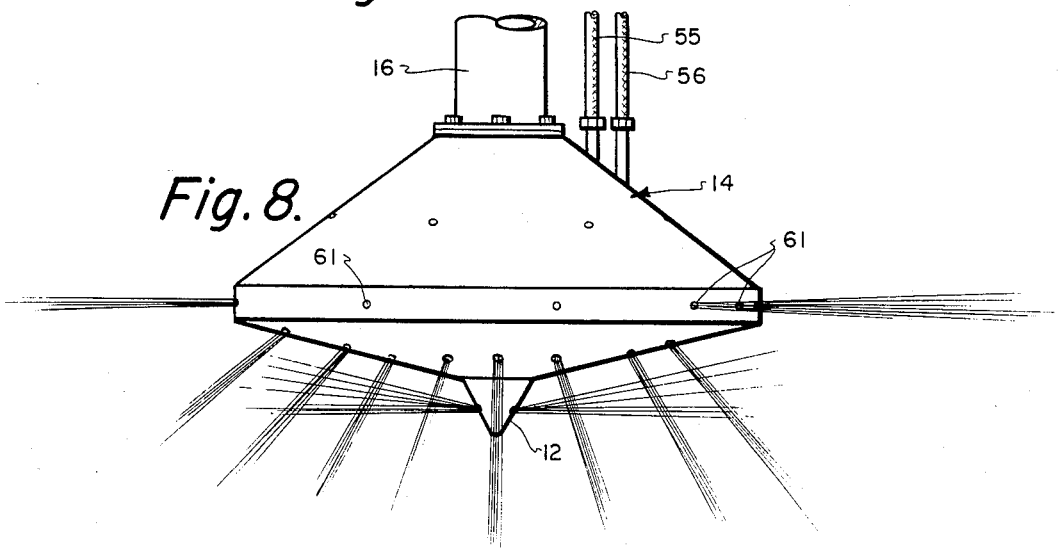
FIG. 8 is an elevational view of a universal footing showing both downward jet flow and circumferential jet flow.

The cone shaped spike 12 is made from high strength steel and is designed to support the structural weight on the leg when the footing is deployed on a coral or rock type seafloor. The spike can indent into coral or rock and will enhance the structural stability against sliding. The bottom of chamber 22 is closed with a nose ring support assembly 35 and spike 12 which is mounted onto the assembly 35. Spike 12 includes a plurality of jet nozzles 37 positioned to direct the jet flow in desired directions. The preferred positioning of the jets 37 from spike 12 is to provide jet flow directed parallel or tangential to the bottom surface of spud-can 14 (this is shown in FIGS. 5 and 8, discussed below). A typical jet nozzle 37 is shown in greater detail in FIG. 3.

The upper end of chamber 22 is closed with plates plates 38 and 39, through which passes inlet 18, for example. In the particular embodiment shown in FIGS. 1 and 2, plate 39 is larger than plate 38 in order to form the flange 17 which extends beyond the outer periphery of chamber cylinder 22. Stiffening ribs 41 are positioned about the circumference of the upper end of the spud-can to strengthen the flange 17, etc., in the area where pile 16 is connected to the universal footing 10. As shown in FIG. 1, pile leg 16 is also provided with a flanged area 43 for connection to flange 17, as well as with stiffener ribs 44 for reinforcement. Various sizes of pile can be accommodated. A typical universal footing of approximately 10 feet diameter and 5 feet in height, can readily accommodate pipe pile sizes from 20 inches to 36 inches in diameter, with appropriate connections/-fittings.

Figure 6:
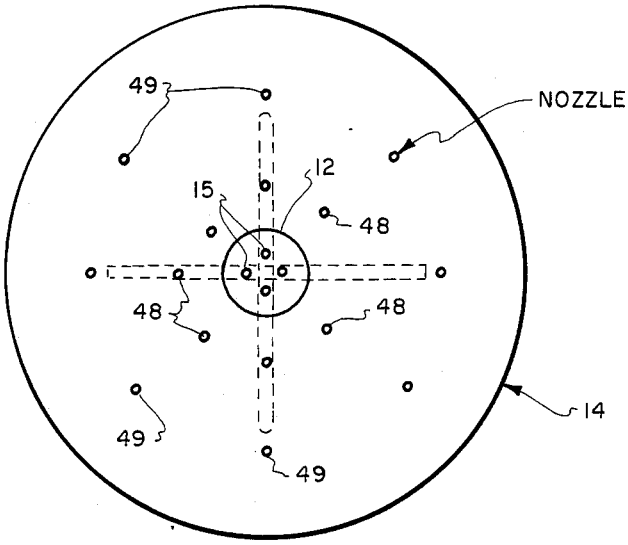
FIG. 6 is a bottom view of a universal footing showing typical locations of jetting nozzles.

Conduits 46 and 47, plus others not shown in FIG. 2, provide a network of passageways to distribute pressurized water, etc. (supplied via pipeline 20) from the interior of chamber 22 to jet nozzle openings 48, 49, etc., about the surface of the outer walls of the spud-can. Typical jetting networks for the universal footing are shown in FIG. 5, for example, and a typical layout for locating jetting nozzles at the bottom of a universal footing is shown in FIG. 6. Any number of separate jet inlets and jetting nozzle networks can be used.

As shown in FIG. 5, separate jet pressure inlets 55 and 56 are connected to separate jetting networks 58 and 59, respectively, by way of example. In this embodiment, jetting network 58 feeds upwardly directed jet nozzles and jetting network 59 feeds downwardly directed and outwardly angled jet nozzles, as well as to the sideways directed nozzles of spike 12 which provides jet flow substantially parallel to or tangential to the bottom of the spud-can 14.

The internal jetting system is designed to fluidize the seafloor soil around the footing 10 such that the universal footing can be buried by its own weight. The jetting action actually assists in the footing burial. FIG. 5 illustrates the fluidized zone which is created about the universal footing by the jetting system. Also shown in FIG. 5 is the location of soil boiling and slight dune creation about the area of penetration into the seafloor. The specific advantages of burying the footing are two fold: first to increase overall stability against sliding, overturning and bearing failures of the marine platform structure; and, second to minimize the likelihood of scour damage.

Figure 7:
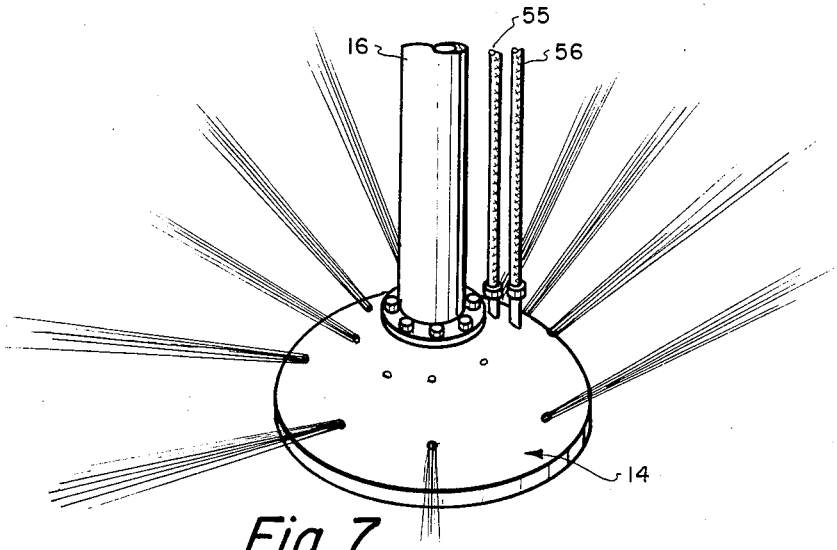
FIG. 7 is a perspective view of a universal footing attached to the bottom of a pile leg and showing upward jet flow.

The jet direction can be controlled either upward, as shown in FIG. 7, or generally downward at an angle, as shown in FIG. 8, for example. FIG. 8 also shows peripheral nozzles 61 about the surface of the outer circumference of spud-can 14, which can be controlled from a separate jet fluid inlet if desired. As previously mentioned the jets from spike 12 are directed tangentially or parallel to the bottom of the spud-can. The tangential flow of the jets from spike 12 further assist the other nozzles in the fluidization of the seafloor soils and help remove soils away from the bottom of the universal footing. All nozzles can be operating at once, if desired, or operate selectively through specific conduit networks. During retrieval use of the jets can also reduce pullout resistance by minimizing the suction and friction resistance of the seafloor soils.

In operation, the universal footing 10 is prefabricated and then attached to each leg 16 of a floating platform. The platform legs with universal footings are first lowered onto a seafloor and then the platform is jacked-up to the desired height above the water surface. Upon completion of the installation of the platform, a water pump (not shown) is connected to the jet inlet or inlets to be used. The only major equipment needed for the jet-in operation is a water pump; no pile hammer or other driving means is needed. If the footing is placed on a sand or silt type seafloor, the downward jets, as in FIG. 8, should be used to induce footing penetration. The jet-in operation can be performed simultaneously on all legs of the platform, or individually as needed. Both the upward and the downward jets can be activated for footing retrieval.

The universal footing with jetting system of the present invention can be deployed on any type of seafloor, such as rock, coral, gravel, sand, silt mud or clay, without a need for changing or modifying the footing. The universal footing can effectively jet into a silt, sand or gravel seafloor to increase the overall structural stability and prevent scour damage, which these sediments are susceptible to during a storm. For a jack-up type marine platform structure, the present invention can reduce by a factor of eight the pile length normally required to be transported and installed. The invention can also effectively speed up foundation installation.

No pile driving or support equipment is needed with the present invention. The jetting system of the universal footing has no moving parts, and will not plug up like eductor/suction systems currently used. This invention dramatically reduces pullout resistance when footing retrieval is needed or when realignment of the marine platform structure may become necessary.

Obviously many modifications and variations of the present invention are possible in the light of the above teachings. It is therefore to be understood that within the scope of the appended claims, the invention may be practiced otherwise than as specifically described.

What is claimed is:

1. A universal footing and jetting system for supporting marine structures on various types of seafloor materials, comprising:

(a) a spud-can structure forming an enlarged footing base particularly useful in soft type sediments and operable to be mounted beneath a marine structure to provide a foundation therefor in seafloor sediments;

(b) a high-strength spike means mounted on the bottom of said spud-can structure which is operable to indent into coral and rock type seafloors for stability against sliding and for supporting said marine structure thereon;

(c) a jetting system for distributing fluid under pressure to a plurality of jet nozzles positioned about top, bottom, and side surfaces of said spud-can; said plurality of jet nozzles being selectively operative for directing jet flow in upwardly, downwardly and sideways directions;

(d) at least one high pressure source for supplying fluid under pressure to said jetting system;

(e) said fluid under pressure being operable to be expelled from said jet nozzles about said spud-can surfaces for causing fluidization and boiling of seafloor soils in the immediate area adjacent to and surrounding said spud-can structure for penetration and self burial of the universal footing into the seafloor, thereby enhancing the overall structural stability of the marine structure thus supported against sliding, overturning, and bearing failures, while minimizing the likelihood of scour damage, and wherein said jetting system nozzles are selectively used during retrieval and repositioning operations of said universal footing to reduce pullout resistance by minimizing suction and friction resistance of seafloor soils.

2. A universal footing and jetting system as in claim 1 wherein said spike means also includes jet nozzles connected to said jetting system.

3. A universal footing and jetting system as in claim 2 wherein the jet nozzles in said spike means are generally positioned to direct their jet flow substantially tangential to the bottom of said spud-can structure.

4. A universal footing and jetting system as in claim 1 wherein said spud-can includes a pressure chamber and distribution networks therein for distribution of said fluid under high pressure through the distribution networks to said jet nozzles.

5. A universal footing and jetting system as in claim 1 wherein the jet nozzles located on the upper side of said spud-can are directed in upwardly and outwardly directions.

6. A universal footing and jetting system as in claim 1 wherein the jet nozzles located on the lower side of said spud-can are directed in downwardly and outwardly directions.

7. A universal footing and jetting system as in claim 1 wherein the jet nozzles located circumferentially about said spud-can are directed in an outwardly direction, generally perpendicular to the penetration direction of the universal footing into the seafloor.

8. A universal footing and jetting system as in claim 1 wherein said at least one high pressure source includes pump means for providing fluid under pressure to said jetting system.

9. A universal footing and jetting system as in claim 1 wherein a plurality of sources for supplying fluid under pressure are respectively connected to a plurality of jet nozzle networks for selectively choosing and operating any of a plurality of jet nozzles for upwardly, downwardly, and outwardly jet directions, and combinations thereof.

10. A universal footing and jetting system as in claim 1 wherein said spud-can structure includes disengaging connection means for readily attaching the universal footing to the lower end of a marine structure support leg, and for removal thereof.

11. A universal footing and jetting system as in claim 1 wherein a plurality of said footings are used on a plurality of legs to a marine structure and operated simultaneously to jet-in and deploy said footings into the seafloor.

12. A universal footing and jetting system as in claim 1 wherein said high pressure fluid is water.

13. A universal footing and jetting system as in claim 1 wherein the jetting system fluidizes the seafloor soil in the area immediately surrounding the footing to allow the universal footing to be buried by its own weight.

14. A universal footing and jetting system as in claim 1 wherein once the universal footing is embedded into a sandy/gravel type of seafloor, air jetted in either of upwardly and downwardly directions through said top and bottom nozzles operates to compact the soils around the footing for better securing the footing in place.

15. A universal footing and jetting system for supporting marine structure on various types of seafloor materials, comprising:

(a) a hollow spud-can structure forming a broad footing base for and operable to be mounted beneath a marine structure to provide a foundation therefor in seafloor sediments;

(b) a high-strength spike means mounted centrally on the bottom of said spud-can structure and being operable to indent into coral and rock type seafloors for stability against sliding and for supporting said marine structure thereon;

(c) high-pressure jetting system networks mounted within said spud-can for distributing fluid under pressure to a plurality of jet nozzles positioned about and contiguous with top, bottom, and side surfaces of said spud-can; said plurality of jet nozzles being selectively operative for directing jet flow in upwardly, downwardly and sideways directions while said spud-can is in contact with and embedded in the seafloor;

(d) at least one high pressure source for supplying fluid under pressure to said jetting system networks;

(e) said fluid under pressure being selectively expelled via selected jetting system networks from various ones of said plurality of jet nozzles about the surfaces of said spud-can in a manner to cause fluidization and boiling of seafloor soils in the immediate area adjacent to and surrounding said spud-can structure for penetration and burial of the universal footing into the seafloor and for easing the release thereof for retrieval.

16. A universal footing and jetting system as in claim 15 wherein said spike means includes jet nozzles connected to said jetting system; said jet nozzles in the spike means being positioned to direct their jet flow substantially tangential to the bottom surface of said spud-can structure for reducing suction and pullout resistance of the universal footing upon retrieval.

17. A universal footing and jetting system as in claim 15 wherein said at least one high pressure source includes pump means for providing fluid under pressure to said jetting system networks.

18. A universal footing and jetting system as in claim 15 wherein said fluid under pressure is water.

19. A universal footing and jetting system as in claim 15 wherein said at least one high pressure source selectively provides fluid under pressure to a plurality of jet nozzle networks within said spud-can for selectively choosing and operating any of a plurality of jet nozzles for upwardly, downwardly, and outwardly jet directions, and combinations thereof.

20. A universal footing and jetting system as in claim 15 wherein once the universal footing is embedded into a sandy/gravel type of seafloor, air jetted in either of an upwardly and downwardly direction through said nozzles operates to compact the soils surrounding and covering the buried footing for better securing the universal footing in place.

21. A universal footing with jettng-in capabilities for marine structure foundations in various types of seafloor materials, comprising:

(a) (a) spud-can means which provides a broad footing base in seafloor soils;

(b) (a) spike means at the bottom of said spud-can means for indenting into coral and rock type surfaces in the seafloor for support and stability against sliding;

(c) jetting means including a network system within and nozzles located about upper and lower surfaces of said spud-can means for fluidizing seafloor soils adjacent to said spud-can means for penetration and self burial of the spud-can and universal footing into the seafloor to secure the universal footing in place, and for decreasing suction below said spud-can and reducing pullout resistance upon retrieval of the universal footing.

* * * * *